US006935971B2

(12) United States Patent
Piras et al.

(10) Patent No.: US 6,935,971 B2
(45) Date of Patent: Aug. 30, 2005

(54) TRAINING TOOL FOR BALL GAMES

(76) Inventors: Fausto Piras, via Cavour, 11-09170 Oristano (IT); Paolo Piras, via Cavour, 11-09170 Oristano (IT)

( * ) Notice: Subject to any disclaimer, the term of this patent is extended or adjusted under 35 U.S.C. 154(b) by 0 days.

(21) Appl. No.: 10/363,919

(22) PCT Filed: Mar. 8, 2001

(86) PCT No.: PCT/IT01/00116

§ 371 (c)(1),
(2), (4) Date: Aug. 4, 2003

(87) PCT Pub. No.: WO02/20099

PCT Pub. Date: Mar. 14, 2002

(65) Prior Publication Data

US 2004/0014537 A1 Jan. 22, 2004

(30) Foreign Application Priority Data

Sep. 8, 2000 (IT) ..... OR2000U0003

(51) Int. Cl.[7] ..... A63B 69/00; A63B 69/34

(52) U.S. Cl. ..... 473/435; 473/422; 473/434; 473/446

(58) Field of Search ..... 473/422, 434, 473/435, 421, 449, 446, 476–478; 273/348, 409, 400–408

(56) References Cited

U.S. PATENT DOCUMENTS

| | | | | | |
|---|---|---|---|---|---|
| 2,944,816 | A | | 7/1960 | Dixon | |
| 3,427,026 | A | * | 2/1969 | Mahoney | 473/435 |
| 3,502,330 | A | * | 3/1970 | Cheftel | 273/395 |
| 3,711,092 | A | * | 1/1973 | Hogue | 473/435 |
| 3,752,476 | A | * | 8/1973 | Mahoney | 473/435 |
| 3,836,144 | A | * | 9/1974 | Mahoney | 473/435 |
| 4,553,751 | A | | 11/1985 | Ketchum | |
| 5,431,411 | A | * | 7/1995 | Padilla | 473/416 |
| 5,556,104 | A | * | 9/1996 | Guillen, Jr. | 473/435 |
| 5,613,922 | A | * | 3/1997 | Hsiang | 473/435 |
| 5,664,784 | A | * | 9/1997 | Redlich et al. | 273/396 |
| 5,772,537 | A | | 6/1998 | Anderson et al. | |
| 5,807,193 | A | * | 9/1998 | Talarico et al. | 473/421 |
| 5,833,234 | A | | 11/1998 | Vavala et al. | |
| 5,938,546 | A | * | 8/1999 | Caruso | 473/434 |
| 6,209,877 | B1 | * | 4/2001 | Warnick | 273/396 |
| 6,250,634 | B1 | * | 6/2001 | Strain et al. | 273/395 |
| 6,402,631 | B1 | * | 6/2002 | Gembarowicz | 473/197 |

FOREIGN PATENT DOCUMENTS

| | | |
|---|---|---|
| EP | 0014133 | 8/1980 |

* cited by examiner

*Primary Examiner*—Mitra Aryanpour
(74) *Attorney, Agent, or Firm*—Browdy and Neimark, P.L.L.C.

(57) ABSTRACT

A training tool (1) for ball games allows an optimal return of the ball itself and a remarkable use flexibility. The tool includes a frame (2) defining a rebound area, ground anchoring apparatus (5) that anchors the frame to the ground, the elastic members (6) which define a surface stretching on the rebound area, and positioning apparatus (8) which permits adjusting the frame to a desired inclination.

8 Claims, 2 Drawing Sheets

TRAINING TOOL FOR BALL GAMES

BACKGROUND OF THE INVENTION

1. Technical Field of the Invention

The present invention refers to a training tool for ball games, of the kind allowing the training of a single player exploiting a rebound effect of the ball shot by the player.

2. Prior Art

Many kinds of sport activities are known wherein the use of such tool is possible, from sports wherein the ball is hit by a bat, a stick or a racket to sports wherein the ball, of various dimensions, is hit or shot with parts of the body: hands, feet and head, such as, e.g., soccer.

Among the various known training tools, those shooting a ball towards the player who has to stop or hit it are particularly well-known. Usually these tools are made to shoot a large number of balls one after the other and suitably provided with a container thereof. As a whole, the structure and the operation of these proper machines are quite complex, and this limits the spreading of those training tools that are not capable of playing the same ball for several shots.

Besides these machines, often alternative solutions are adopted using a wall against which a ball is shot which rebounds and returns back towards the player that shot it.

A fixed wall has a widespread use in sports using a racket, such as e.g. tennis, table tennis, squash and sports not using a racket, most of all soccer, to allow the players to improve their ball shots.

However, the use of the fixed wall is not always satisfying, on one side because the return of the ball towards the player depends on the strength with which the ball was shot and on the other because the ball rebounds with an angle that depends on the ball rotation effect and most of all on the direction thereof, so that shots or kicks having an irregular direction or an excessive effect bring the rebound far from the player who is forced to run after the ball itself.

OBJECT AND SUMMARY OF THE INVENTION

In this connection, U.S. Pat. No. 5,833,234 (Vavala et al.), U.S. Pat No. 5,772,537 (Anderson et al.), EP-A-0,014,133 (Cheftel) and U.S. Pat. No. 2,944,816 (Dixon) disclose rebounding apparatuses wherein irregular rebounds may be caused by an incorrect inclination of the rebound area and by the presence of a four side frame contouring said rebound area.

The technical problem underlying the present invention is to provide a training tool allowing to overcome the above mentioned drawbacks with reference to the known art.

Said problem is overcome by a training tool comprising:

a rectangular frame, defining a flat rebound area;

ground anchoring means of said frame;

elastic means defining a surface stretching on said rebound area; and positioning means of said frame according to a desired inclination, characterized in that said frame, consists of a pair of posts and a cross bar, the posts forming the shorts sides of the rectangle and the cross bar forming the top thereof, and in that said frame is rotatably anchored to the ground whereby said rebound area can be inclined of 30° with respect to a vertical plane toward and from the playing side, said positioning means of the frame comprising a pair extensible bars diagonally arranged in the side opposite to said playing side and connected, at the respective ends, to the frame, at the top corner formed by the posts and cross bar, and to the ground.

The main advantage of the training tool according to the present invention lies in allowing a positioning thereof with an optimal inclination and such as to obtain a return of the ball in the desired direction. The use of a stretched surface on a flat area allows then an elastic return of the ball amplifying the power with which it was shot, eliminating at the same time at least a part of the undesired consequences of an excessive effect.

The invention also relates to the use of the training tool as defined above, for the training and/or practice in a ball game, in particular soccer.

BRIEF DESCRIPTION OF THE DRAWINGS

The present invention will be described herebelow according to a preferred embodiment along with some of its preferred applications thereof, given as a non-limiting example and with reference to the annexed drawings wherein.

BRIEF DESCRIPTION OF THE PREFERRED EMBODIMENT(S) OF THE INVENTION

Figure 2A:
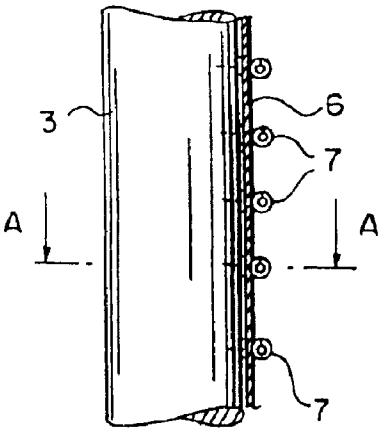
FIGS. 2*a* and 2*b* show a detail of the tool of FIG. 1 in elevation and in section.
Figure 2B:
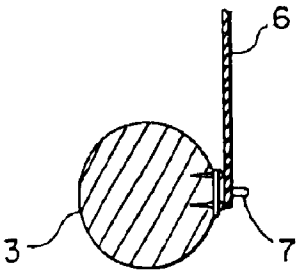
Figure 1:
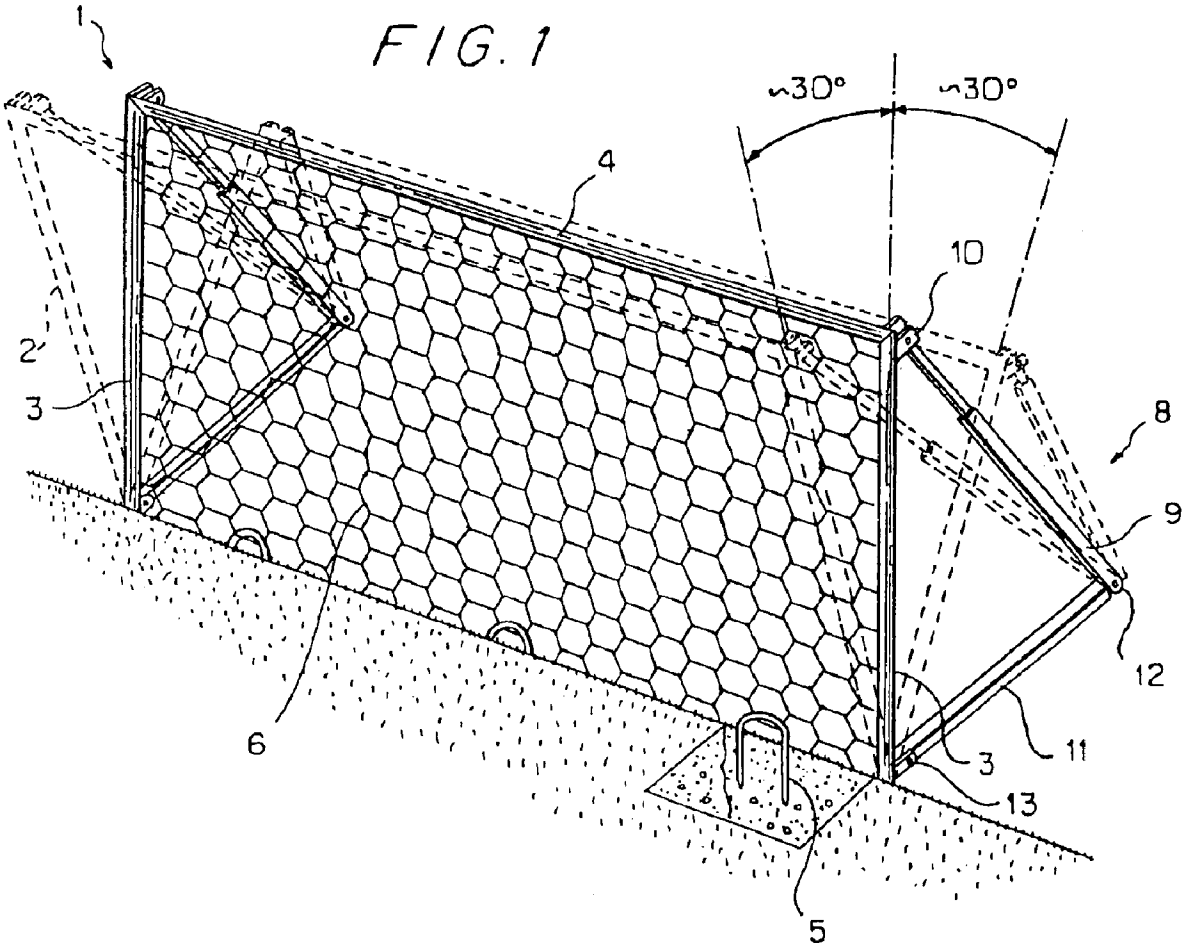
FIG. 1 shows a perspective and animated view of a training tool according to the present invention.

With reference to FIG. 1, a training tool is indicated as a whole with 1. It comprises a rectangular frame 2 composed of a pair of posts 3 and by a cross bar 4, in a soccer goal-lookalike arrangement.

According to a first version of the present embodiment, the posts 3 and the cross bar 4 are formed by circular- or possibly rectangular-sectioned tubular posts. The width of the post can vary from a maximum to a minimum, depending if it has to be used as target for the ball shots or not.

The posts 3 form the short sides of the rectangle, while the cross bar 4 forms the top thereof.

Said frame 2 is rotatably anchored to the ground at the side opposite to that of the cross bar 4. In this regard, the frame 2 comprises anchors 5 apt to be driven in the ground, possibly thanks to the use of a sledge.

The rectangular frame 2 defines a rebound area, flat in the present embodiment, wherein elastic means are placed, in the present embodiment a hexagonal-meshed net 6, defining an elastic surface on said rebound area.

The net 6 is stretched between the posts and the ground. In this regard, said net is fixed or hooked to protruding clamps 7 which are fixed to the posts. The configuration is such as to unhook the net 6 should this be required and modify the stretching thereof.

Therefore the stretching will be adjustable to deaden a ball shot against the net 6 or to send it back at an equal speed with an elastic return.

Said net 6 is formed by highly resistant elastic nylon wires.

Furthermore, the tool 1 comprises positioning means 8 of the frame 2 according to a desired inclination. Said positioning means, in the present embodiment, comprise a pair of extensible bars 9, diagonally arranged and fixed to the corner formed by the posts and the cross bar (the so-called "top corner") and the ground at the respective ends.

The connection is of a rotatable kind and is made by a first hinge 10.

The extensible bars 9 can vary their length by changing the inclination of the frame 2 with respect to the ground. In a preferred example, the extensible bars 9 are of a telescopic kind, having a length varying at releases corresponding to predetermined inclinations.

In order to provide a higher stability to the whole, the tool 1 comprises ground bars 11 connecting the base of each post 3 with the far end of the respective extensible bar 9.

The connection between ground bars 11 and extensible bars 9 is of a rotatable kind and it is made with respective second hinges 12. The connection between ground bars 11 and post bases 3 comprises as well third hinges 13.

According to a variant, the ground bars 11 can be extensible. According to a further variant, the basis of the two posts 3 can be connected by a transversal stiffener bar. Also the ground bars 11 can be connected by a further bar, extending between the second hinges 12. The clamps 5 are fixed to the stiffener bar.

All the above mentioned connections among bars, posts and cross bar can be made in a disassembling way in order to allow the tool 1 to be completely disassembled.

Also the members delimiting the rebound area, the posts 3 and the cross bar 4, can be extensible in order to vary the stretching of the rebound area. Furthermore, the shape of the rebound area is not necessarily rectangular, but can vary since it can be delimited by a different number of sides, possibly curved as well. The rebound area as well is not necessarily flat, but could be hollow or convex according to the different uses thereof.

It is also to be understood that the anchoring means could comprise other fixing means besides the above described anchors, among which are stakes, ropes and many more.

With reference to figures from 3*a* to 3*c*, the use of the above mentioned tool in soccer training will be described herebelow, wherein the preferred shape of the flat rebound area is rectangular with proportions similar to those of the soccer goal but having smaller dimensions with respect to the latter.

An example of possible dimensions for a frame 2 suitable for soccer is: height: 2.00 m; width: 4.00 m; posts and cross bar front thickness: 0.06 m; resulting dimensions of the rebound area $1.92\times3.88=7.45\ m^2$; height:width ratio: around 0.50.

As previously said, the transversal dimensions of posts and cross bar can be increased; furthermore, these members could offer to the player a flat rather the curved surface.

Figure 3A:
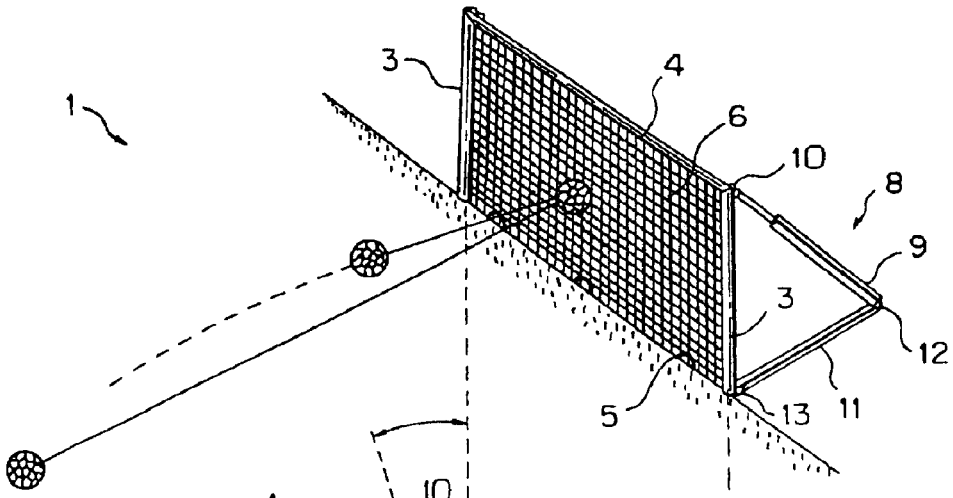
FIGS. 3*a*, 3*b* and 3*c* show three different positions of the tool of FIG. 1 and illustrate the different possible uses thereof.

Three ways of using the tool, illustrated as non-limitative examples for all other possible uses, are described herebelow. According to the first (FIG. 3*a*), the rebound area is vertical, forming a 90° angle with the ground.

In this configuration, a soccer player will practice kicking the ball against the rebound area, obtaining a regular return. By reducing the stretching of the net, the soccer player will be able to stay at a close range to shoot very powerfully and obtain a soft return of the ball. On the other hand, by increasing the stretching, the net shall amplify possible imperfections in the ball touch, allowing therefore the soccer player to improve his/her technical skills.

Figure 3B:
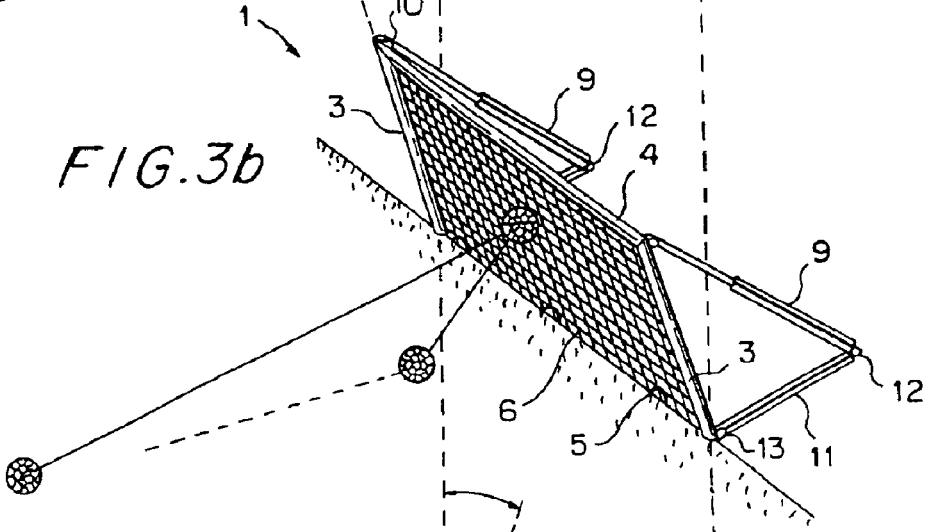

In a second use (FIG. 3*b*), the frame, and thus the rebound area, is inclined of 30° towards the playing side with respect to the vertical side thereof. Playing side is understood to be that side wherein the player is placed for practice.

In this configuration, the ball shot towards the net is smashed on the ground and possibly deaden according to the predetermined stretching of the net. This allows the practice of the shoot power, i.e. of the player quadriceps. If the player places laterally rather than frontally, he/she will have the chance to train also the adductor muscles used in angled shots.

Figure 3C:
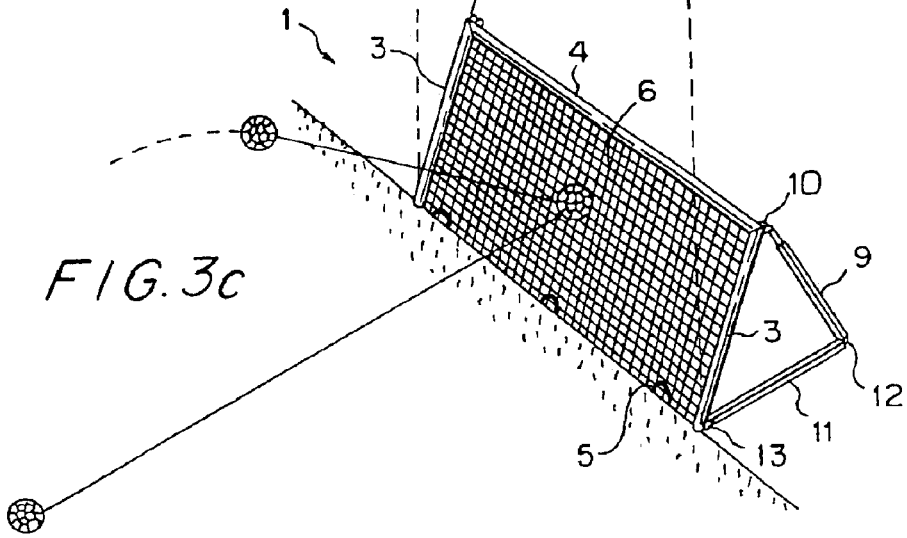

In a third use (FIG. 3*c*), the frame, and thus the rebound area, is inclined of 30° from the playing side with respect to the vertical side thereof. Therefore, the horizontally shot ball will rebound upwards.

In this configuration, it is possible to shot towards the net powerfully and obtain a trajectory allowing goalkeepers to practice the dive or elevation save. On the same kind of trajectory, the soccer players will be able to practice both on accurate and return air shooting. It is to be understood that the flexibility allowed by the above described tool structure will permit the use thereof according to further configurations for specific kinds of training besides the usual ways of technical and physical training.

In particular, this tool will turn out to be useful in muscle and tendons rehabilitation of injured players, who will have the chance to husband their efforts acting on the net stretching to recover the regular motion of limbs and articulation.

Furthermore, the tool will turn out to be particularly effective in teaching ball games and improving the individual technical skills, being therefore indicated for schools and sport schools.

The same flexibility will allow the tool to suit the training for different sports among those wherein a ball is used.

In order to satisfy particular requirements and contingencies, a person skilled in the art will be able to carry out numerous further modifications and variations to the training tool described above, without departing thereby from the protective scope of the invention as defined by the following claims.

What is claimed is:

1. A training tool for soccer games comprising:

a rectangular frame (2) consisting of a pair of posts (3) and a cross bar (4), the posts (3) forming short sides of the frame (2) and the cross bar (4) forming the top of the frame (2), the posts (3) and the cross bar (4) defining a flat rebound area;

an elastic net (6) stretched on the rebound area;

anchors (5) engaged to a bottom edge of the elastic net (6) to fix the frame to the ground; and positioning apparatus comprising a pair of extensible bars (9) diagonally arranged at a side opposite to a playing side of the training tool, first ends of the extensible bars (9) respectively connected at top corners of the frame (2), and secured ends of the extensible bars (9) adapted to engage the ground;

wherein when the anchors (5) fix the frame (2) to the ground the frame (2) is rotatable around free ends of the posts (3) to permit the extensible bars (9) to adjust the rebound area between 30° from a vertical position of the rebound area towards the playing side and 30° from the vertical position away from the playing side.

2. The tool (1) according to claim 1, wherein the posts (3) and the cross bar (4) have a flat surface.

3. The tool (1) according to claim 1, wherein the posts (3) and the cross bar (4) are formed by circular-sectioned tubular poles.

4. The tool (1) according to claim 1, wherein the stretching of the net (6) on the rebound area is adjustable.

5. The tool (1) according to claim 1, wherein said extensible bars (9) are connected at the top corner formed by the posts (3) and cross bar (4) by hinges (10, 12).

6. Use of the training tool (1) as defined in claim 1, for the training and/or practice in a ball game.

7. The tool according to claim 1, wherein ground bars (11) are respectively hinged between each of the face ends of the posts (3) and each of the second ends of the extensible bars (9).

8. The tool according to claim 1, wherein the outer dimensions of the frame are smaller than that of a conventional soccer goal.

* * * * *